US005844993A

United States Patent [19]

Iida et al.

[11] Patent Number: 5,844,993

[45] Date of Patent: Dec. 1, 1998

[54] SURROUND SIGNAL PROCESSING APPARATUS

[75] Inventors: Toshiyuki Iida, Kawasaki; Tomohiro Mouri, Musashino, both of Japan

[73] Assignee: Victor Company of Japan, Ltd., Yokohama, Japan

[21] Appl. No.: 590,497

[22] Filed: Jan. 24, 1996

[30] Foreign Application Priority Data

Jan. 25, 1995 [JP] Japan ..... 7-028665
Jun. 6, 1995 [JP] Japan ..... 7-161583

[51] Int. Cl.[6] ..... H04R 5/00

[52] U.S. Cl. ..... 381/18; 381/17; 381/1

[58] Field of Search ..... 361/1, 18, 19, 361/17, 61; 381/20–22, 63

[56] References Cited

U.S. PATENT DOCUMENTS

| | | | |
|---|---|---|---|
| 3,670,106 | 6/1972 | Orban | 381/17 |
| 3,746,972 | 7/1973 | Scheiber . | |
| 4,076,959 | 2/1978 | Gilbert et al. | 381/1 |
| 4,159,397 | 6/1979 | Iwahara et al. . | |
| 4,349,698 | 9/1982 | Iwahara . | |
| 4,625,326 | 11/1986 | Kitzen et al. | 381/17 |
| 4,783,814 | 11/1988 | Foley | 381/17 |
| 5,579,396 | 11/1996 | Iida et al. | 381/18 |

FOREIGN PATENT DOCUMENTS

| | | | |
|---|---|---|---|
| 0 228 851 A | 12/1986 | European Pat. Off. . | |
| 0412725 | 2/1991 | European Pat. Off. | 381/17 |
| 0 535 276 A | 10/1991 | European Pat. Off. . | |
| 0 615 399 A | 3/1994 | European Pat. Off. . | |
| 5-207597 | 8/1993 | Japan . | |
| 06 289 858A | 10/1994 | Japan . | |

*Primary Examiner*—Curtis A. Kuntz
*Assistant Examiner*—Xu Mei
*Attorney, Agent, or Firm*—Michael N. Meller

[57] ABSTRACT

A surround signal processing apparatus for reproducing surround sound through a pair of speakers arranged at front left and right positions with respect to a listener, based on a monaural rear surround signal input. A sound image localization apparatus is used, as well as a signal processing apparatus having a comb filter to render mutually non-correlative, a left-right pair of rear surround signals based on the monaural rear surround sound signal input.

6 Claims, 6 Drawing Sheets

SURROUND SIGNAL PROCESSING APPARATUS

BACKGROUND OF THE INVENTION

1. Field of the Invention

This invention relates to surround signal processing apparatus for applications such as Dolby surround sound or high-definition television (HDTV) sound reproduction.

2. Description of Prior Art

Recent years have seen widespread use of multi-channel stereophonic sound in audio/visual systems. The trend in the technology has been away from conventional stereo sound reproduction systems, and toward "surround sound" techniques where the sound field is dynamically (and intentionally) shifted to the sides of and behind the listener, in concert with the video scene.

Known in the art as sound field control methods, are reproduction methods such as the "Dolby surround" and HDTV "3-1" techniques, in which, through sound image localization, sound sources that would normally require rear speakers can be reproduced by conventional stereo sound systems having only two front speakers, with results equivalent to those of multi-channel stereo systems. The Dolby surround active matrix technique employed in the sound field control systems described in U.S. Pat. No. 3,746,792, for example, is one such known system.

In the above conventional sound field control systems, however, the rear sound was single-channel (monaural) sound only. Consequently, the system lacked the ability to adequately represent the sound field to the rear of the listener, or to clearly represent movement of the sound image. Accordingly, a weakness of these systems was that sound reproduced by only two loudspeakers positioned to the left and right in front of the listener failed to evoke the desired feeling of expansiveness.

In multi-channel audio systems having surround signal processing systems such as the "3-1" (three front—one rear channel) technique used in HDTV and Dolby surround sound reproduction systems, in particular, since the rear surround sound was monaural, the surround sound reproduction equipment simply split this rear channel into two identical rear (SR and SL) channels. Consequently, when these signals were reproduced by the speakers, for a listener in the center of the sound system, the (virtual) location of the sound source tended to be localized inside the listener's head, thus defeating the surround effect of the original signal.

Even in standard five-speaker sound reproduction, when the localized sound image locations are laterally symmetrical with respect to the two rear speakers, the localized location often ends up inside the head.

Accordingly, to prevent this inside-the-head localization, the signals for the monaural rear sound image being localized need to be made different in some way. In Japanese patent "kokai"(laid open) document No. H5(1993)-207597, for example, measures such as adding reflected sound by inverting the phase on one side, or changing delay times were used.

However, adding different amounts of delay to the SL and SR signals of a two-channels system had the disadvantage that it skewed the sound image to one side or the other. Also, while inverting the phase between the left and right sides improved the left-right separation, it also evoked a strong perception of the phase inversion (a disagreeable and unnatural characteristic in the sound).

BRIEF SUMMARY OF THE INVENTION

1. Objects of the Invention

It is an object of this invention to obtain surround signal processing apparatus in which, when the rear sound signal is a single monaural signal, the correlation between the left and right rear signals is reduced, to thereby achieve improved surround sound field control that enhances the naturalness of the sound and creates a feeling of expansiveness.

It is a further object of this invention to obtain surround signal processing apparatus in which, when the rear sound signal is a single monaural signal, if a virtual sound image reproduced by the image localization process is localized to laterally-symmetrical locations behind the listener (a situation conducive to inside-the-head localization), inside-the-head localization is avoided by enhancing an acoustic effect occurring in pseudo-stereo processing, and a surround space with naturalness and a heightened sense of expansiveness can thereby be created.

2. Brief Summary

Provided, according to a first aspect of this invention, is surround signal processing apparatus for reproducing, from a pair of loudspeakers placed in front of and substantially laterally symmetrical with respect to a listener, surround sound based on input of a rear monaural surround signal input, comprising:

a signal processing means for performing signal processing required to render mutually non-correlative, a left-right pair of rear surround signals that are based on said rear monaural surround signal input.

Further provided, according to a second aspect of this invention, is surround signal processing apparatus for reproducing, from a pair of loudspeakers placed in front of and substantially laterally symmetrical with respect to a listener, surround sound based on input of a rear monaural surround signal input, comprising:

a signal processing means for performing signal processing required to render mutually non-correlative and pseudo-stereophonic, a left-right pair of surround signals that are based on said rear monaural surround signal input; and an amplitude adjustment means for establishing an amplitude difference between said pair of rear surround sound signals.

The above and other related objects and features of the invention will be apparent from a reading of the following description of the disclosure found in the accompanying drawings, and the novelty thereof pointed out in the appended claims.

DETAILED DESCRIPTION OF THE INVENTION

<First Embodiment>

Figure 1:
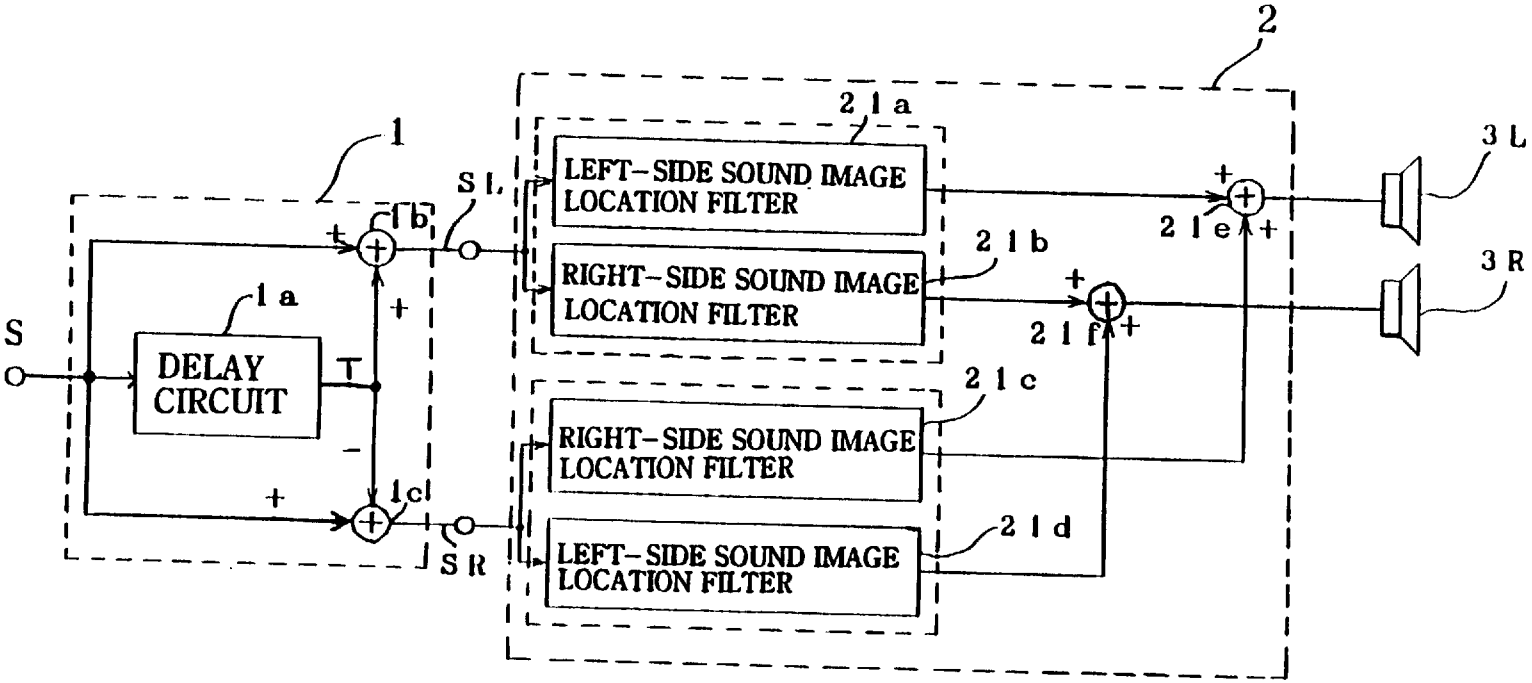
FIG. 1 is a block diagram of a first embodiment of the surround signal processing apparatus of the present invention.

FIG. 1 is a block diagram of a first embodiment of the surround signal processing apparatus of the present invention.

In FIG. 1, item 1 is a comb filter that, in a multi-channel sound reproduction system that employs monaural rear surround sound reproduction, functions as a signal processing means that adds a delay to a monaural rear surround signal S (hereinafter referred to simply as a "surround signal") which is supplied to it after its level has been adjusted by a master level controller (not shown), and produces therefrom, signals that are the sum and difference signals of the "base" (pre-delay) signal and the delayed signal, which it outputs as two-channel rear surround signals.

The comb filter1 has a delay circuit 1*a* that adds a delay (in a range, for example, of 0–20 ms) to the input surround signal S, and outputs it as delay signal T; a summing circuit 1*b* that obtains a sum signal (S+T) by adding delay signal T to base surround signal S, and outputs the result as the L channel rear surround signal SL; and a subtraction circuit 1*c* that obtains a difference signal (S−T), by subtracting delay signal T from base surround signal S, and outputs the result as the R channel rear surround signal SR.

Figure 2:
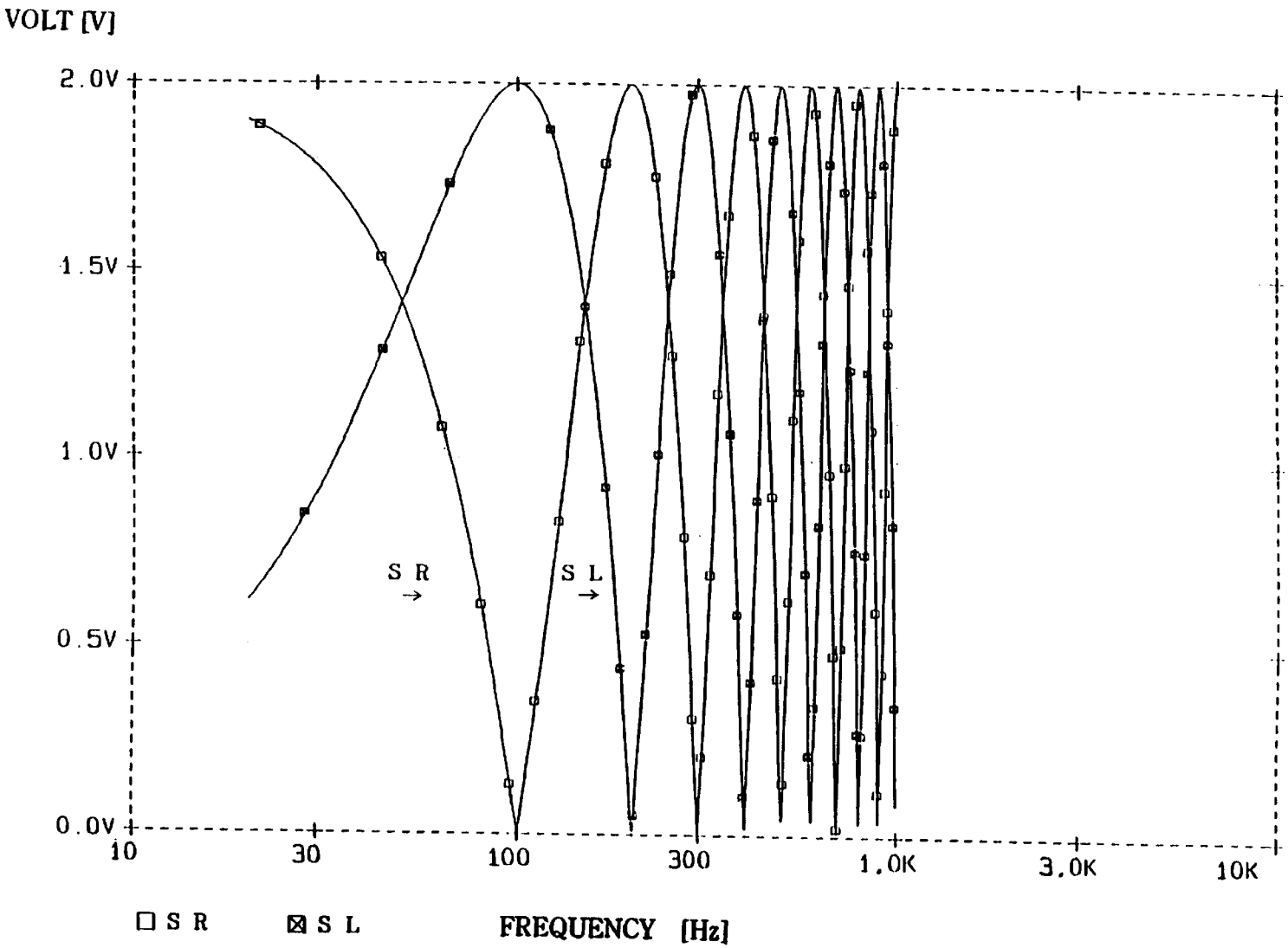
FIG. 2 is a graph of the filter characteristics of the comb filters shown in FIG. 1.

FIG. 2 is a graph of output signal amplitude characteristics, that explains the effect obtained in comb filter 1, which delays surround signal S and produces sum and difference signals from the delayed and base signals, and outputs the resulting signals as 2-channel rear surround signals, as described above.

As shown in FIG. 2, by passing the base rear surround signal S through comb filter 1, left-right separation in the frequency spectrum is effected, thus producing 2-channel rear surround signals SL and SR which have low left-right correlation, and good surround effect is thereby achieved.

Referring again to FIG. 1, item 2 is a sound image localization circuit for performing a process to localize the sound image for each side to specific locations to the side and rear of the listener. It does this by performing additional summing of the filter processing results of each of the 2-channel rear surround signals SL and SR from comb filter 1. Items 3L and 3R in the drawing represent loudspeakers placed to the left and right in front of the listener.

Provided in sound image localization circuit 2, as previously proposed by this inventor in Japanese patent application H5(1993)-208871, are, in each of two separate rear surround signal channels SL and SR, an L-channel sound image localization circuit having left-and right-side sound image localization filters 21*a* and 21*b*, each of which have one of a pair of convolvers defined to have transfer functions Hl and Hr based on human head-related transfer functions for locations to the rear of, and substantially laterally-symmetrical with respect to, the listener, a similar R-channel sound image localization circuit having right-and left-side sound localization filters 21*c* and 21*d*, an adder 21*e* that sums the outputs of left-side filters 21*a* and 21*d*, and an adder 21*f* that sums the outputs of right-side filters 21*b* and 21*a*. Also, the signals, having been output from sound image localization circuit 2 and localized to specific rear locations, are reproduced as sound by the pair of front speakers 3L and 3R.

With the front left and right sound signals also being summed in adders 21*e* and 21*f*, the sound produced by this pair of speakers 3L and 3R, is, in fact, surround sound.

Here, as in mentioned Japanese patent application H5(1993)-208871, Hl, the transfer function of left-side sound image localization filters 21*a* and 21*d*, and Hr, that of right-side sound image localization filters 21*b* and 21*c*, are as follows:

$$Hl=(SF-AK)/(S^2-A^2) \quad (1.1)$$

and $$Hr=(SK-AF)/(S^2-A^2) \quad (1.2),$$

where

S is the transfer characteristic from one speaker of speaker pair 3L/3R to the listener's ear on the same side as the speaker;

A is the transfer characteristic from one speaker of speaker pair 3L/3R to the listener's ear on the side opposite the speaker;

F is the transfer characteristic from a location (on either side) to which the surround signal is to be localized, to the listener's ear on the same side; and K is the transfer characteristic a the location (on either side) to which the surround signal is to be localized, to the listener's ear on the opposite side.

To obtain the above S, A, F, and K transfer characteristics, actual measurements are performed: Loudspeakers are placed at specific locations in an anechoic space, measurement data is taken from microphones positioned at both ears of a human (or dummy) head, and the measured data is then subjected to appropriate waveform processing.

Also, in the above and following equations, the "+" sign indicates addition of transfer characteristics, "−" indicates subtraction of transfer characteristics, and "/" indicates inverse convolution.

In addition, the term "same side" denotes, for example, the right ear for the right-hand speaker; while the term "opposite side" denotes, for example, the left ear for the right-hand speaker.

Accordingly, with the above described system configuration, separation in the frequency spectrum of the left and right components of base surround signal S is accomplished by feeding base surround signal S through comb filter 1, thereby obtaining the 2-channel (left and right) rear surround signals SL and SR having low correlation between channels. In addition, in sound image localization circuit 2, the signals are subjected to further filter processing and the results summed, to localize each signal image to the rear. In addition, the system is arranged such that these sound-image-localized signals are reproduced as sound by a single pair of front speakers 3L and 3R.

By so doing, the rear sound can be localized into left-rear and right-rear virtual sound images, and the correlation between the two can be made to range from no correlation to weak correlation, thus obtaining extremely good surround sound, and in particular, a surround space can be created, that is natural and evokes a heightened sense of expansiveness.

<Second Embodiment>

Figure 3:
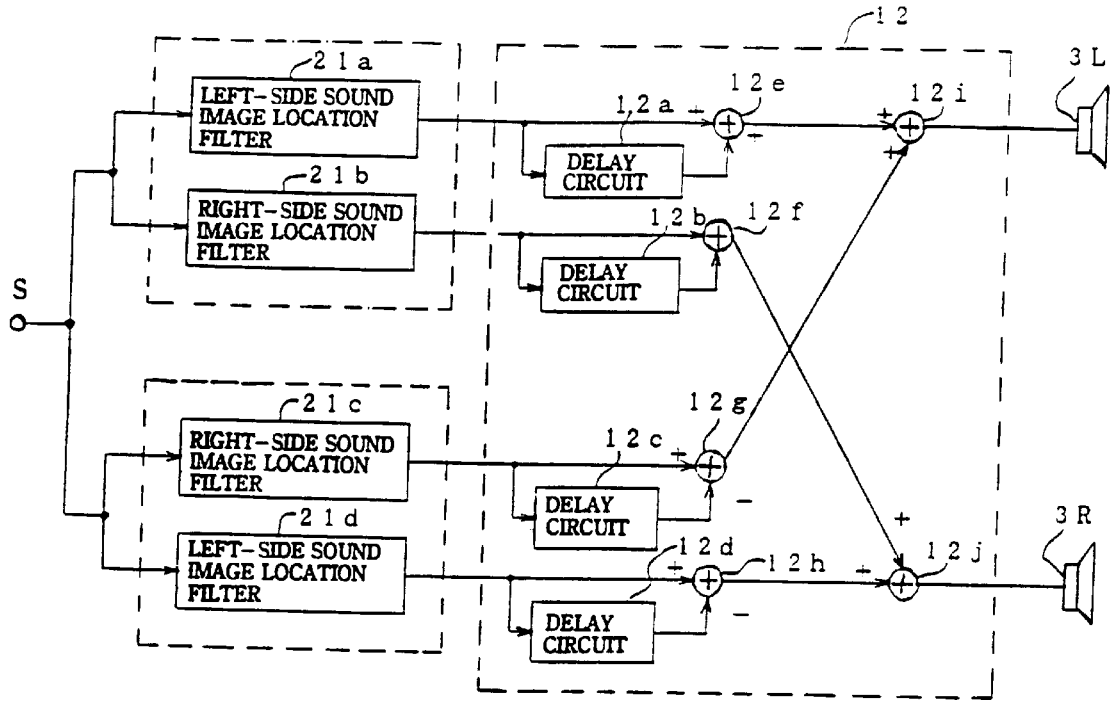
FIG. 3 is a block diagram of a second embodiment of the surround signal processing apparatus of the present invention.

FIG. 3 is a block diagram of a second embodiment of the surround signal processing apparatus of the present invention. The configuration of the second embodiment shown in FIG. 3 is a modified version of the first embodiment described above.

That is, in the first embodiment, rear surround signals SL and SR, after having passed through comb filter 1, are further filtered in sound image localization processor circuit 2, and the filtered results summed, thus localizing the sound image of each signal to the rear, after which the resulting sound-image-localized signals are reproduced by a pair of front speakers, 3L and 3R. In the second embodiment, on the other hand, the signal is first sound-image-localized by an L-channel sound localization circuit having left-and right-side sound image localization filter pair 21*a* and 21*b*, and by an R-channel sound localization circuit having right-and left-side sound image localization filter pair 21*c* and 21*d* (which are the same as the same-numbered circuits in the first embodiment), after which the resulting signals are fed through comb filter 12 to render them as 2-channel rear surround signals having low left-right correlation, which are reproduced by a pair of front speakers, 3L and 3R.

In this second embodiment, the mentioned comb filter 12 comprises: delay circuits 12*a* through 12*d*, which provide delayed version of the outputs they receive from the filters in each of the L-channel and R-channel sound image localization circuits;

adders 12*e* and 12*f*, which add the signals fed through delay circuits 12*a* and 12*b*, respectively, to the pre-delay versions of the same signals, to obtain sum signals;

subtractors 12*g* and 12*h*, which take the difference between the signals fed through delay circuits 12*c* and 12*d*, respectively, and the pre-delay versions of the same signals, to obtain difference signals;

adder 12*i*, which outputs a sum signal obtained by adding the output of adder 12*e* to the output of subtractor 12*g;* and adder 12*j*, which outputs a sum signal obtained by adding the output of adder 12*f* to the output of subtractor 12*h*.

According to this second embodiment, then, surround signals that have been sound-image-localized by L-channel and R-channel sound image localization circuits are processed by comb filter 12 to obtain 2-channel rear surround signals having low left-right correlation, which are then reproduced by a pair of front speakers 3L and 3R. Therefore, as in the first embodiment, the rear sound can be localized into left-rear and right-rear virtual sound images, and the correlation between the two can be made to range from no correlation to weak correlation, thus obtaining extremely good surround sound, and in particular, a surround space can be created that is natural and evokes a heightened sense of expansiveness.

<Third Embodiment>

Figure 4:
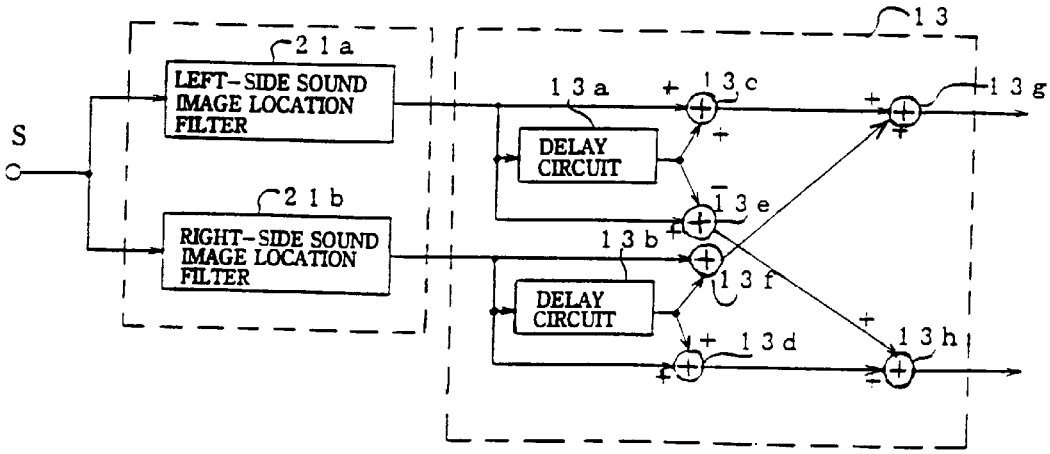
FIG. 4 is a block diagram of a third embodiment of the surround signal processing apparatus of the present invention.

FIG. 4 is a block diagram of a third embodiment of the surround signal processing apparatus of the present invention. As shown in FIG. 4, in this third embodiment, fewer delay circuits are used in the comb filter than were used in the second embodiment shown in FIG. 3. This, in turn, simplifies the sound image localization circuit filter configuration, in a system configuration that is the functional equivalent of that in the second embodiment.

That is, in this third embodiment, shown in FIG. 4, comb filter 13 comprises delay circuits 13*a* and 13*b*, which provide delayed versions of the outputs they receive from their associated sound image localization circuit filters;

adders 13*c* and 13*d*, which add the signals fed through delay circuits 13*a* and 13*b*, respectively, to the pre-delay versions of the same signals, and output sum signals;

subtractors 13*e* and 13*f*, which take the difference of the signals fed through delay circuits 13*a* and 13*b*, respectively, and the pre-delay versions of the same signals, and output difference signals;

adder 13*g*, which outputs a sum signal obtained by adding the output of adder 13*c* to the output of subtractor 13*f;* and adder 13*h*, which outputs a sum signal obtained by adding the output of adder 13*d* to the output of subtractor 13*e*.

In the third embodiment, then, an equivalent function is performed with half as many delay circuits as are used in the comb filter of the second embodiment, shown in FIG. 3.

Similarly, in the sound image localization circuit as well, the left and right sound image localization filters 21*c* and 21*d* used for two-speaker sound reproduction in the second embodiment shown in FIG. 3 can also be omitted, thus reducing this circuit to only the two left and right sound image localization filters 21*a* and 21*b*.

<Fourth Embodiment>

Figure 5:
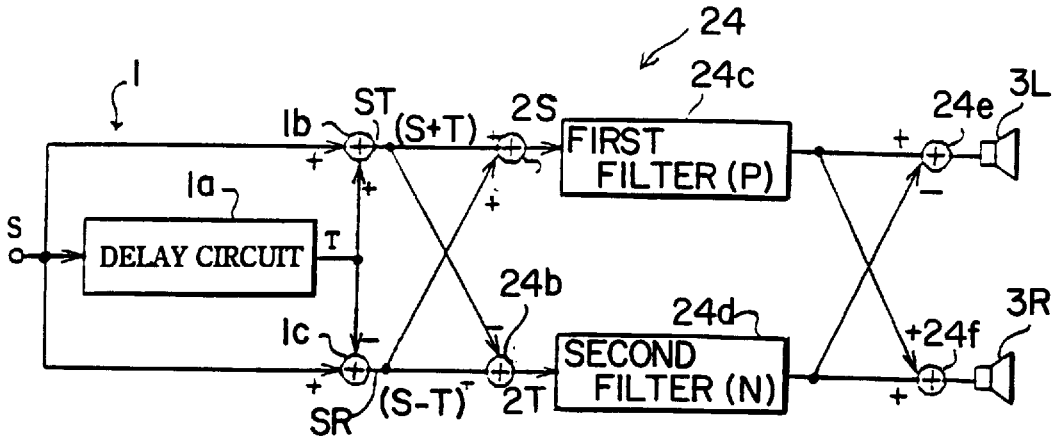
FIG. 5 is a block diagram of a fourth embodiment of the surround signal processing apparatus of the present invention.

FIG. 5 is a block diagram of a fourth embodiment of the surround signal processing apparatus of the present invention. In this fourth embodiment shown in Fig.5, sound image localization circuit 2 of the first embodiment, shown in FIG. 1, is simplified through the use of shuffler filters (see Duane H. Cooper and Jerald L. Bauck, "Prospects for Transaural Recording", J. Audio Eng. Soc., Vol. 37, No. 1/2, 1989 January/February, pp. 3–9).

That is, in the fourth embodiment shown in FIG. 5, sound image localization circuit 24 comprises:

adder 24*a*, which adds sum signal (S+T), the sum of the 2-channel rear surround signals SL and SR (sum signals obtained by adding versions of surround signal S that have been delayed by different amounts) received from comb filter 1, to the corresponding difference signal (S−T);

subtractor 24*b*, which takes the difference between sum signal (S+T) and difference signal (S−T);

first filter 24*c*, which has a transfer characteristic P (to be discussed later) and which receives the output of adder 24*a* as its input, on which it performs convolution, etc.;

second filter 24*d*, which has a transfer characteristic N (to be discussed later) and receives the output of subtractor 24*b* as its input, on which it performs convolution, etc.;

subtractor 24*e*, which outputs the difference of the outputs of first and second filters 24*c* and 24*d;* and adder 24*f*, which adds the outputs of first and second filters 24*c* and 24*d*.

Finally, signals that have been sound-image-localized by this sound localization circuit 24 to specific substantially laterally symmetrical locations behind a listener, are reproduced by the pair of front speakers 3L and 3R.

Here, P, and N, the transfer characteristics of first and second filters 24*c* and 24*d*, as previously proposed by this inventor, in Japanese patent application H5(1993)-208871, are given by the following equations:

$$P=(F+K)/(S+A) \tag{2.1}$$

$$N=(F-K)/(S-A) \tag{2.2},$$

where F, K, S, and A, are as defined earlier.

In surround signal processing apparatus so constituted, separation in the frequency spectrum of base surround signal S is accomplished by feeding base surround signal S through comb filter 1, thereby obtaining the 2-channel (left and right) rear surround signals, SL and SR, having low correlation between channels, and a good surround effect is achieved.

In addition, when the 2-channel surround signals SL and SR are processed through sound image localization circuit 24, which has Shuffler filters, and the resulting signals are then reproduced by a pair of speakers 3L and 3R in front of a listener, the cross-talk, that is, the sound from left speaker 3L that circles into the listener's right ear, and that from the right speaker 3R that circles into the listener's left ear, will be canceled, with the result that only the sound from the left speaker can be heard in the listener's left ear, and only the sound from the right speaker can be heard in the listener's right ear, and in addition, the processing in accordance with transfer characteristics F and K will result in sound images being localized at specific substantially laterally symmetrical locations to the rear of the listener.

<Fifth Embodiment>

Figure 6:
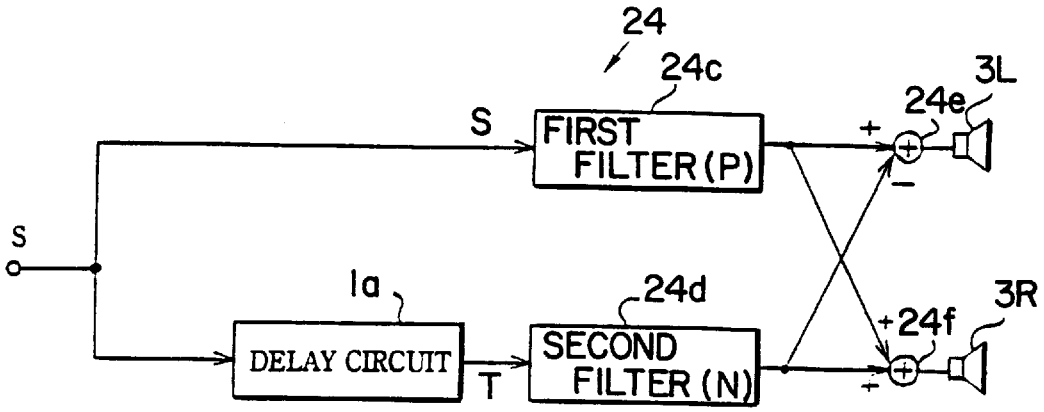
FIG. 6 is a block diagram of a fifth embodiment of the surround signal processing apparatus of the present invention.

FIG. 6 is a block diagram of a fifth embodiment of the surround signal processing apparatus of the present invention. As shown in FIG. 6, the configuration of this fifth embodiment is the functional equivalent of that of the fourth embodiment, shown in FIG. 5.

That is, in the fifth embodiment, as in the fourth embodiment shown in FIG. 5 and discussed above, there are only two front speakers, and Shuffler filters are used in the sound image localization circuit to localize rear surround signals SL and SR to specific laterally symmetrical locations to the rear of the listener. Unlike the fifth embodiment, however, in the Shuffler filter portion of the fourth embodiment, the sum and difference signals of the two input signals are taken, and the resulting signals fed through first and second filters 24*c* and 24*d*, having transfer characteristics P and N, respectively, to localize their sound images to the desired locations.

In this fourth embodiment, the two input signals are (S+T) and (S−T), and their sum and difference signals are 2S and 2T, respectively. Now, if the "2," in these signals, which represents gain, were to be omitted, the signals being processed here would be S and T. Since the only difference between the original S and T signals, however, was in a delay or a lack of it, these S and T signals could be obtained by simply making "with delay" and "without delay" input signals, and the filter processing then performed on these signals.

In the Dolby surround technique, in particular, an about 20 ms (millisecond) delay is applied to the surround signal to obtain separation between the front sound and surround signals. It follows, then, that the same result can be accomplished by the simpler configuration of the fifth embodiment, shown in FIG. 6. Here, a surround signal S, that has been delayed about 20 ms, is injected into first filter 24*c*, and that same signal S fed through delay circuit 1*a* to obtain a signal T, delayed by about (20+5) ms, which is then input into second filter 24*d*.

Figure 7:
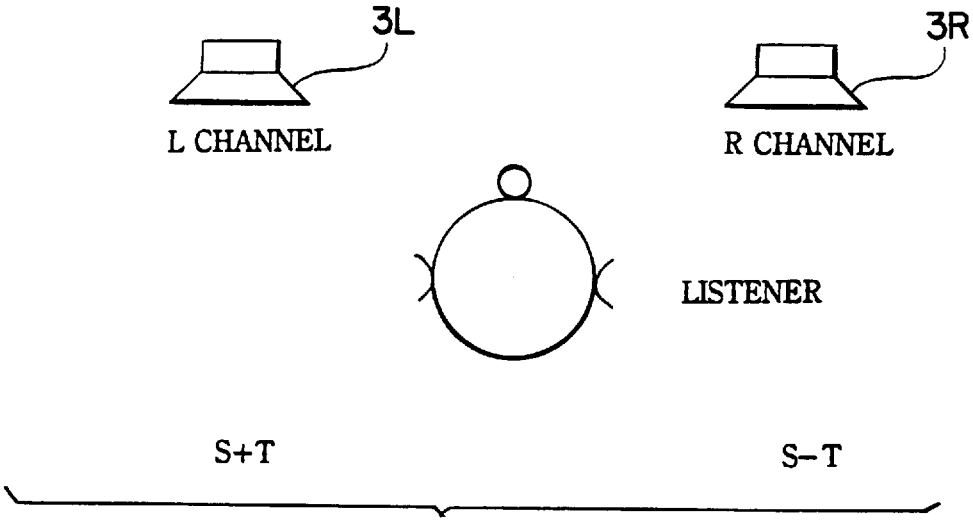
FIG. 7 is a diagram showing the localized positions when a rear surround virtual sound image is localized from a pair of loudspeakers placed in substantially laterally-symmetrical locations in front of a listener.

In the configurations of the fourth and fifth embodiments discussed above and shown in FIG. 5 and FIG. 6, since the input surround sound signal S is a monaural signal, it is passed through comb filter 1 of the fourth configuration, and the functional equivalent thereof in the fifth configuration, to obtain the required non-correlated signals. To obtain one of these signals (S+T), adder 1*b* adds signal S to a delayed signal T obtained by passing S through delay circuit 1*a*. To obtain the other (S−T), adder 1*c* takes the difference between S and the delayed signal T. These signals are then input as virtual sound image sound source signals to the sound image localization circuit previously proposed by this inventor, in Japanese patent application H5(1993)-208871, which, for the rear sound, can then localize the virtual sound images S+T and S−T, to laterally symmetrical locations behind the listener, as shown in FIG. 7.

When the configuration of FIG. 5 is expressed in equation form, however, P{in} and N{in}, which are the inputs to first and second filters 24*c* and 24*d*, respectively, are $$P\{in\}=(S+T)+(S-T)=2S \tag{3.1}$$

$$N\{in\}=(S+T)-(S-T)=2T \tag{3.2}$$

In other words, the same result can be realized by using surround signal S, as—is, as the input to first filter 24*c*, P{in}, and the delayed signal T, the delayed version of signal S, as the input to second filter 24*d*, N{in}. If the drawing is similarly changed, it becomes the same as FIG. 6, the diagram of the fifth embodiment.

In addition, in the configuration of embodiment 4, shown in FIG. 5, the positive/negative relationship of adders 1*b*, and 1*c*, may also be reversed for the summing of the signal T, which was delayed by passing it through circuit 1*a*. If the sign of delayed signal T is changed, P{in} and N{in}, the inputs to first and second filters 24*c* and 24*d*, become $$P\{in\}=(S-T)+(S+T)=2S \tag{4.1}$$

$$N\{in\}=(S-T)-(S+T)=-2T \tag{4.2}$$

Similarly, the signs of the signals input to adders 24*a* and 24*b* in sound image localization circuit 24, can be changed:

$$P\{in\}=(S+T)-(S-T)=2T \tag{5.1}$$

$$N\{in\}=(S+T)+(S-T)=2S \tag{5.2}$$

This can be accomplished by inputting the delayed signal T to first filter 24*c* and the surround signal S, as—is, to second filter 24*d*.

<Sixth Embodiment>

Figure 8:
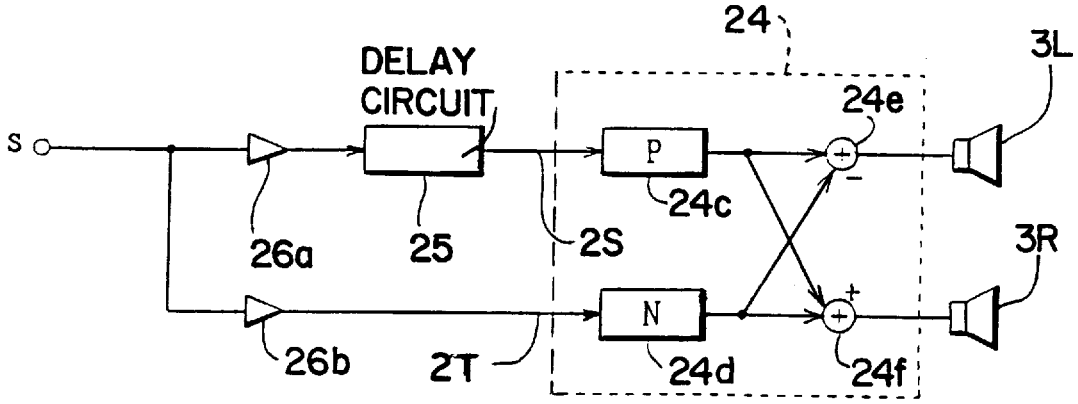
FIG. 8 is a block diagram of a sixth embodiment of the surround signal processing apparatus of the present invention.

FIG. 8 is a block diagram of a sixth embodiment of the surround signal processing apparatus of the present invention. In this sixth embodiment, as shown in FIG. 8, when performing the signal processing expressed by equations 5.1 and 5.2, above, in addition, to enhance the sense of expansiveness of the sound field, an amplitude difference is also established between the signals input to first and second filters 24*c* and 24*d*.

That is, as shown in FIG. 8, amplitude adjustment amplifier 26*a* is provided ahead of delay circuit 25 on the first filter 24*c* input side, as an amplitude adjustment means for establishing an amplitude difference between the left and right surround signals. Also, amplitude adjustment amplifier 26*b* is provided on the second filter 24*d* input side, and the amplitude adjustment ratios (gain) of amplitude adjustment amplifiers 26*a* and 26*b* adjusted to provide the desired amplitude difference.

If, in FIG. 8, the first filter 24*c* side input were made 0, this would be equivalent to the signal processing method previously proposed by this inventor, in Japanese patent application H5(1993)-208871.

That is, the left-right relationships of the localized virtual sound images in the left-right direction, as shown in FIG. 7 would be expressed by T and −T. In other words, if delay is ignored, this is the equivalent of localizing the virtual sound to the left and right by phase inversion. Inverting the phase between left and right sides prevents inside-the-head localization and provides the desired feeling of expansiveness, but a sense of the phase inversion remains.

By properly adjusting the amplitude of the first filter 24*c* side input, however, the desired sense of expansiveness can be retained while at the same time avoiding the characteristic unnatural sense of localization associated with phase inversion.

In this embodiment, non-correlation between signals is effected by introducing a time difference between the two rear surround signals, thus creating a pair of pseudo-stereophonic rear surround signals. The delaying means that provides this time difference (by delaying the signal in one channel) is delay circuit 25, which is set, for example, for a delay of 5 ms (milliseconds). In addition, an amplitude difference between channels is effected by setting the amplitude adjustment ratios of amplitude adjustment amplifiers 26*a* and 26*b* such that signal level input to first filter 24*c* of sound image localization circuit 20 is about 2dB down with respect to that at second filter 24*d*.

This provides an input to the second filter 24*d* channel that is not only time-delayed with respect to the other channel (that is a precedence effect), but also has a different amplitude. The end result is the reproduction of a sound field that has a highly effective sense of expansiveness.

Although FIG. 8 shows delay circuit 25 in the first filter 24*c* channel, it could also be in the second filter 24*d* channel.

<Seventh Embodiment>

Figure 9:
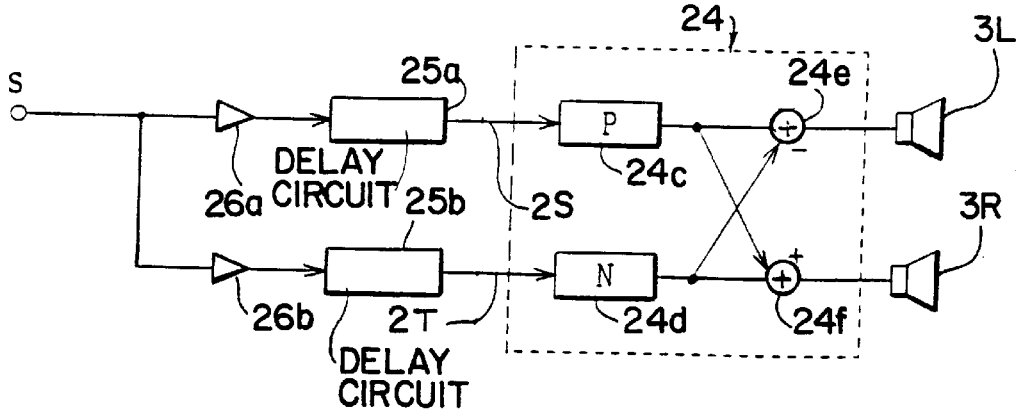
FIG. 9 is a block diagram of a seventh embodiment of the surround signal processing apparatus of the present invention.

FIG. 9 is a block diagram of a seventh embodiment of the surround signal processing apparatus of the present invention. As shown in FIG. 9, this seventh embodiment, improves on configuration in FIG. 8 by providing delay circuits 25*a* and 25*b*, as delay circuits for the input stages of first and second filters 24*c* and 24*d*, respectively.

This configuration enables the time delays of first and second filters 24*c* and 24*d* to be set in any desired relationship. Since the channel amplitudes can also be set as desired, the time delay and amplitude relationships can be set as desired for the best effect.

The input levels of filters 24*c* and 24*d* can be changed, for example, to match the particular listening room environment. For a dead room, for instance, the first filter 24*c* channel input level could be increased by an appropriate amount to soften the sense of phase inversion, and for a live room, the same channel input could be lowered to sharpen the clarity of the virtual image. A variety of sound fields can be created in this manner.

<Eighth Embodiment>

In digital signal processing (DSP) when the actual signal processing is performed, since there is only one surround sound channel, a single delay line can be used, and with good efficiency. In addition, by tapping off signals delayed by different amounts at appropriate points on the delay line, reflected sound can be added to the signal, to add a sense of distance to the virtual sound images, to create the perception in the listener of being present in a concert hall or theater.

Figure 10:
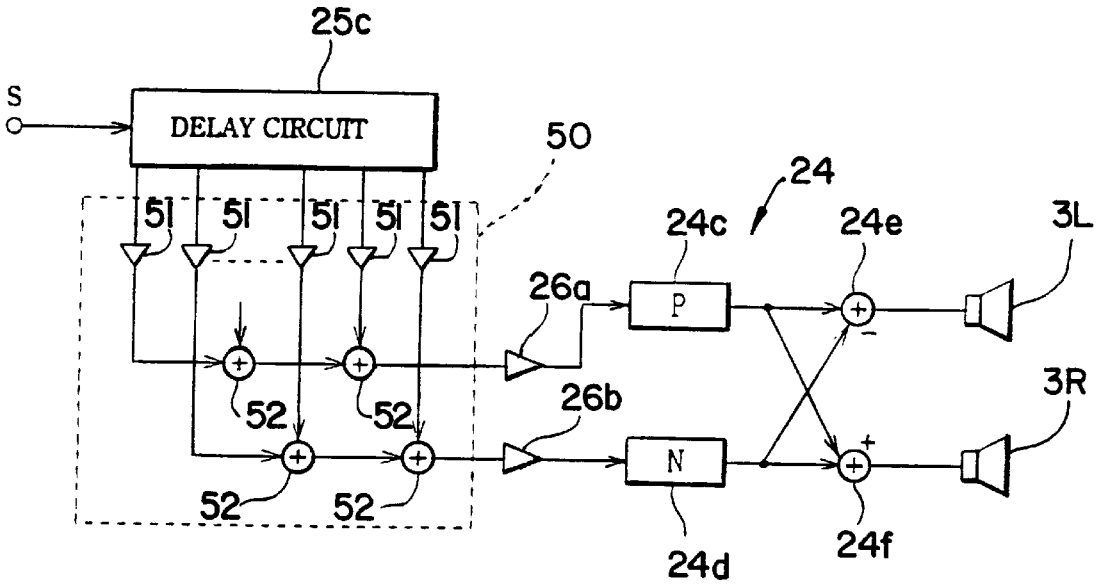
FIG. 10 is a block diagram of an eighth embodiment of the surround signal processing apparatus of the present invention.

With the eighth embodiment of this invention, as shown in FIG. 10, the sound field can be enlarged using reflected sound adder circuit 50 to add reflected sound signal components to a pair of pseudo-stereophonic rear surround signals. Reflected sound adder circuit 50 accomplishes this by properly adjusting the amplitude of multiple rear surround signals, each delayed by a different amount, and then summing the resulting signals.

This reflected sound adder circuit 50 adds a reflected sound component to, and outputs, a pair of pseudo-stereophonic rear surround signals. It does this by taking multiple rear surround signals S having different delay times from a delay line 25*c* used as a delaying means, appropriately adjusting the amplitudes of these multiple rear surround signals S in amplitude adjustment amplifiers 51, and then summing the resulting signals in adders 52.

By adding reflected sound in this manner, extremely good sound field reproduction can be achieved for listening in a wide range of acoustic environments, from huge spaces, such as in large dome structures to very small spaces such as in mini-theaters. Furthermore, it is to be noted that perfect simulation of frequency phase characteristics of head transfer characteristics can be realized by using FIR (Finite Impulse Response) filters as first and second filters 24*c* and 24*d*, in FIGS. 8, 9, and 10.

<Application Examples>

In the above description of the first through eighth embodiments, the embodiments were discussed in terms of surround reproduction by two front loudspeakers. In addition to this, however, this system will also work well in systems having the normal 2-channel (left and right) signals, with signals split off for three front L, R, and C (left right and center), and one rear (monaural) channel, for a total of five speaker channels. Also, if a two channel surround signal is reproduced in the rear speakers of a normal 5-speaker surround system, the reduced correlation between channels provided by this invention will provide improved performance with respect to in-the-head localization problems, and excellent surround effect.

<Effects of the Invention>

The following beneficial effects may be realized from the use of the surround signal processing apparatus of this invention as described above:

(1) In sound field control, it will be possible to effect extremely good surround sound field control, with little or no correlation between left and right rear surround components, and in particular, to create a highly natural surround space with a heightened sense of expansiveness.

(2) In sound field control, with respect to the rear sound, it will be possible to localize virtual sound images in laterally symmetrical locations to the rear.

(3) In sound field control, it will be possible to take a pair of surround sound signals that have been rendered non-correlative by a comb filter, and localize these surround signals, with a sound image localization circuit, to substantially laterally symmetrical locations to the rear of the listener, and thereby, with an extremely simple circuit configuration, to provide rear sound field representation and sound image motion with a high degree of clarity, thus achieving an entirely adequate surround effect.

(4) In sound field control, it will be possible to take a pair of sound signals that have been localized to substantially laterally symmetrical locations to the rear of the listener by a sound image localization circuit, and, with a comb filter, render them non-correlative, and thereby, with an extremely simple circuit configuration, to provide rear sound field representation and sound image motion with a high degree of clarity, thus achieving a fully adequate surround effect.

(5) It will be possible, by setting transfer characteristics, to give breadth to the image localization location, and set the range of surround reproduction.

(6) When the rear sound signal is a single monaural signal, and when virtual sound images localized to laterally-symmetrical locations behind the listener are being reproduced, and pseudo-stereophonic processing is performed to avoid localization inside the listener's head, it will be possible to soften the perception of phase inversion [that accompanies such conditions] by manipulating the amplitudes of two rear surround signals to enhance the acoustic effect, and thereby create a natural surround space having a heightened sense of expansiveness.

(7) It will be possible to create an amplitude differential between a pair of rear surround signals, and thereby reproduce sound fields with effective expansiveness.

(8) It will be possible to set amplitudes and delay times as desired, and thereby reproduce sound fields with effective expansiveness.

(9) It will be possible to individually set the amplitudes and delay times of a pair of rear surround signals as desired, to select values so as to realize the maximum effect, to thereby create virtual images with clarity and a variety of sound fields.

(10) For rear sound, it will be possible to localize virtual images to laterally symmetrical locations to the rear, and create a natural surround space having a heightened sense of expansiveness.

(11) It will be possible to add a sense of distance to the virtual sound images, to create the perception in the listener of being present in a concert hall or theater, and along with this, extremely good sound field reproduction for listening in a wide range of acoustic environments can be achieved.

What is claimed is:

1. A surround signal processing apparatus for reproducing multi-channel audio signals, including a pair of left and right rear surround signals, based on an input of a rear monaural surround signal, through a pair of speakers arranged at front left and right positions substantially symmetrically with respect to a listener, the apparatus comprising:

signal processing means including a comb filter having a time delay for generating sum and difference signals from delayed and pre-delayed versions of said rear monaural surround signal, for performing signal processing to render mutually non-correlative, said pair of left and right rear surround signals; and sound image localizing means for performing signal processing to localize a sound image substantially symmetrically at left and right positions behind a listener, based on said input of said pair of left and right rear surround signals that have been signal processed by said comb filter of said signal processing means, said sound image localizing means including a pair of convolvers, each respectively having a filter coefficient Hl and Hr set on the basis of head transfer functions based on human head-related transfer functions substantially symmetrically at left and right positions behind a listener for each channel of a pair of said left and right rear surround signals to satisfy the following Equations (1) and (2):

$$Hl=(SF-AK)/(S^2-A^2) \quad (1)$$

$$Hr=(SK-AF)/(S^2-A^2) \quad (2)$$

where S is the transfer function from each of a pair of the speakers to each listener's ear existing on the same side of the speaker; A is the transfer function from each of a pair of the speakers to each listeners's ear existing on the opposite side of the speaker; F is the transfer function from a position at which each sound image is required to be localized to each listener's ear existing on the same side of each speaker; and K is the transfer function from a position at which each sound image is required to be localized to each listener's ear existing on the opposite side of each speaker, said sound image localizing means adding an output of the convolver whose filter coefficient is set to Hl for one channel to an output of the other channel convolver whose filter coefficient is set to Hr for the other channel, and further outputting a pair of the added outputs as a pair of filtered rear left and right surround signals.

2. A surround signal processing apparatus for reproducing multi-channel audio signals, including a pair of left and right rear surround signals, based on an input of a rear monaural surround signal, through a pair of speakers arranged at front left and right positions substantially symmetrically with respect to a listener, the apparatus comprising:

sound image localizing means for performing signal processing to localize a sound image substantially symmetrically at left and right positions behind a listener, based on said input of said rear monaural surround signal, said sound image localizing means including convolvers each respectively having a filter coefficient Hl and Hr set on the basis of head transfer functions based on human head-related transfer functions substantially symmetrically at left and right positions behind a listener for each channel of a pair of said left and right rear surround signals to satisfy the following Equations (1) and (2)

$$Hl=(SF-AK)/(S^2-A^2)$$

$$Hr=(SK-AF)/(S^2-A^2)$$

where S is the transfer function from each of a pair of the speakers to each listener's ear existing on the same side of the speaker; A is the transfer function from each of a pair of the speakers to each listener's ear existing on the opposite side of the speaker; F is the transfer function from a position at which each sound image is required to be localized to each listener's ear existing on the same side of each speaker; and K is the transfer function from a position at which each sound image is required to be localized to each listener's ear existing on the opposite side of each speaker; and signal processing means including a comb filter having a time delay for generating sum and difference signals from delayed and pre-delayed versions of a pair of left and right rear surround signals outputted from said sound image localizing means, for performing signal processing to render mutually non-correlative, said pair of left and right rear surround signals that are filtered by said sound image localizing means, said signal processing means adding an output of the convolver whose filter coefficient is set to Hl for one channel to an output of the other-channel convolver whose filter coefficient is set to Hr for the other channel, and further outputting a pair of the added outputs as a pair of filtered rear left and right surround signals.

3. A surround signal processing apparatus for reproducing multi-channel audio signals, including a pair of left and right rear surround signals, based on an input of a rear monaural surround signal, through a pair of speakers arranged at front left and right positions substantially symmetrically with respect to a listener, the apparatus comprising:

signal processing means including a comb filter having a time delay for generating sum and difference signals from delayed and pre-delayed versions of said rear monaural surround signal, for performing signal processing to render mutually non-correlative, said pair of left and right rear surround signals; and sound image localizing means for performing signal processing to localize a sound image substantially symmetrically at left and right positions behind a listener, based on said input of said pair of left and right rear surround signals that have been signal processed by said comb filter of said signal processing means, said sound image localizing means including;

a first adder for adding sum and difference signals outputted as said pair of left and right rear surround signal from said comb filter of said signal processing means;

a first subtractor for subtracting said sum signals and said difference signals;

a first filter for receiving an output from said adder and performing thereon a convolution process;

a second filter for receiving an output from said subtractor and performing thereon a convolution process;

a second subtractor for subtracting the output of said first filter from the output of said second filter; and a second adder for adding the outputs of said first and said second filters, transfer functions P and N of said first and second filters, respectively satisfying the following Equations (3) and (4):

$$P=(F+K)/(S+A) \quad (3)$$

$$N=(F-K)/(S-A) \quad (4)$$

where S is the transfer function from each of a pair of speakers to each listener's ear existing on the same side of the speaker; A is the transfer function from each of a pair of the speakers to each listener's ear existing on the opposite side of the speaker; F is the transfer function from a position at which each sound image is required to be localized to each listener's ear existing on the same side of each speaker; and K is the transfer function from a position at which each sound image is required to be localized to each listener's ear existing on the opposite side of each speaker, said sound image localizing means outputting respective outputs of said second subtractor and said second adder as a pair of filtered rear left and right surround signals.

4. A surround signal processing apparatus for reproducing multi-channel audio signals, including a pair of left and right rear surround signals, based on an input of a rear monaural surround signal, through a pair of speakers arranged at front left and right positions substantially symmetrically with respect to a listener, the apparatus comprising:

amplitude adjustment means for establishing an amplitude difference between said pair of left and right rear surround signals, said amplitude adjustment means including a pair of amplitude adjustment devices with mutually differing amplitude adjustment ratios, for adjusting the amplitudes of said pair of left and right rear surround signals;

time delay means for establishing a time difference between said pair of left and right surround signals, the delay time of said time delay means being variably settable;

sound image localizing means for performing signal processing to localize a sound image substantially symmetrically at left and right positions behind a listener, based on said input of said pair of left and right rear surround signals having a time difference therebetween established by said time delay means, said sound image localizing means including a first filter for receiving a delayed one of said pair of left and right rear surround signals and performing thereon a convolution process;

a second filter for receiving a non-delayed one of said pair of left and right rear surround signals and performing thereon a convolution process;

a subtractor for subtracting the output of said first filter from the output of said second filter; and an adder for adding the outputs of said first and said second filters, transfer functions P and N of said first and second filters, respectively satisfying the following Equations (3) and (4):

$$P=(F+K)/(S+A) \quad (3)$$

$$N=(F-K)/(S-A) \quad (4)$$

where S is the transfer function from each of a pair of the speakers to each listener's ear existing on the same side of the speaker; A is the transfer function from each of a pair of the speakers to each listener's ear existing on the opposite side of the speaker; F is the transfer function from a position at which each sound image is required to be localized to each listener's ear existing on the same side of each speaker; and K is the transfer function from a position at which each sound image is required to be localized to each listener's ear existing on the opposite side of each speaker, said sound image localizing means outputting respective outputs of said subtractor and said adder as a pair of filtered rear left and fight surround signals.

5. The surround signal processing apparatus of claim 4, wherein said delay means comprises a pair of delay means, having different delay times, for delaying a pair of rear surround signals.

6. The surround signal processing apparatus of claim 4, further comprising:

a reflected sound adder circuit for adding a reflected sound component to said pair of rear surround signals by adjusting the amplitude of, and summing, a plurality of rear surround signals of different amplitudes, based on input of said rear monaural surround signal.

* * * * *